US010343835B2

(12) United States Patent
Klipstine et al.

(10) Patent No.: US 10,343,835 B2
(45) Date of Patent: Jul. 9, 2019

(54) EASY-OPEN SELF-VENTING MICROWAVABLE TRAY AND OVERWRAP

(71) Applicant: BEMIS COMPANY, INC., Neenah, WI (US)

(72) Inventors: Keith A. Klipstine, Appleton, WI (US); Brian K. Murdick, Columbus, OH (US); Blake A. Bougie, Neenah, WI (US); Tara K. Cruz, Appleton, WI (US)

(73) Assignee: Bemis Company, Inc., Neenah, WI (US)

( * ) Notice: Subject to any disclaimer, the term of this patent is extended or adjusted under 35 U.S.C. 154(b) by 684 days.

(21) Appl. No.: 14/893,225

(22) PCT Filed: Jul. 25, 2013

(86) PCT No.: PCT/US2013/052021
§ 371 (c)(1),
(2) Date: Nov. 23, 2015

(87) PCT Pub. No.: WO2015/012836
PCT Pub. Date: Jan. 29, 2015

(65) Prior Publication Data
US 2016/0130064 A1 May 12, 2016

(51) Int. Cl.
*B65D 81/00* (2006.01)
*B65D 81/34* (2006.01)
(Continued)

(52) U.S. Cl.
CPC ..... *B65D 81/343* (2013.01); *B65D 75/5833* (2013.01); *B65D 77/003* (2013.01);
(Continued)

(58) Field of Classification Search
CPC ..... B65D 65/00; B65D 65/02; B65D 65/04; B65D 65/06; B65D 65/10; B65D 65/12;
(Continued)

(56) References Cited

U.S. PATENT DOCUMENTS 2,633,284 A * 3/1953 McFarland ..... A23L 3/364 126/369
2,674,536 A * 4/1954 Fisher ..... B65D 77/2012 206/525
(Continued)

FOREIGN PATENT DOCUMENTS

EP 0249260 A2 12/1987
WO 9609967 4/1996
(Continued)

*Primary Examiner* — Ernesto A Grano
(74) *Attorney, Agent, or Firm* — Amy L. De Coster

(57) ABSTRACT

The present invention relates to improved manually openable self-venting ovenable packages which include a rigid or semi-rigid tray having a single thermoplastic overwrap comprising a polymeric laminate surrounding the tray and having a front panel and an opposing back panel. The inventive packages also include a continuous seal circumscribing a recessed cavity of the tray which comprises a heat seal formed by heat sealing a portion of the front panel to the peripheral flange of the tray. The packages of the present invention are self-venting whereby a venting region comprising a release coating applied between the inner surface of the front panel and the inner surface of the back panel permits the overwrap to rupture and release steam in response to heat and/or overpressure generated during heating of a food item in a microwave oven. The inventive packages also includes a manual tear opening feature provided by at least one line of weakness in the front panel positioned between the peelable seal and the first side edge
(Continued)

of the front panel. The tear opening feature is configured to permit partial or complete removal of the overwrap from the tray.

26 Claims, 9 Drawing Sheets

(51) Int. Cl.
*B65D 75/58* (2006.01)
*B65D 77/00* (2006.01)
*B65D 77/20* (2006.01)

(52) U.S. Cl.
CPC ..... *B65D 77/2032* (2013.01); *B65D 77/2036* (2013.01); *B65D 2205/00* (2013.01)

(58) Field of Classification Search
CPC .... B65D 65/40; B65D 65/403; B65D 65/406; B65D 75/30; B65D 75/58; B65D 75/5833; B65D 75/5855; B65D 77/2032; B65D 77/2036; B65D 77/003; B65D 2205/00
USPC ..... 206/484
See application file for complete search history.

(56) References Cited

U.S. PATENT DOCUMENTS 3,069,043 A * 12/1962 Bishop ..... B65D 77/0486 220/573.4
3,188,215 A * 6/1965 Snow, Jr. ..... B65D 75/30 206/497
3,281,051 A * 10/1966 O'Brien ..... B65D 75/5833 206/485.1
3,286,909 A * 11/1966 Scharre ..... B65D 77/0433 229/207
3,349,985 A * 10/1967 Salway ..... B65D 1/34 206/521
3,650,775 A * 3/1972 Simon ..... B65B 25/067 206/484.1
3,659,584 A * 5/1972 Doyle ..... A47J 27/04 126/369
3,741,427 A * 6/1973 Doyle ..... A47J 36/022 126/377.1
3,874,548 A * 4/1975 Buff, Jr. ..... B65D 77/003 206/484
3,918,608 A * 11/1975 Faller ..... A47K 10/421 206/557
4,268,736 A * 5/1981 Cuvelier ..... B23K 13/025 219/613
4,483,125 A * 11/1984 Suga ..... B65B 9/067 53/372.5
4,548,852 A * 10/1985 Mitchell ..... B65D 21/08 206/497
4,625,495 A 12/1986 Holovach
4,703,148 A 10/1987 Mikulski et al.
4,786,513 A 11/1988 Monforton et al.
4,874,620 A 10/1989 Mendenhall et al.
4,939,332 A 7/1990 Hahn
5,039,001 A * 8/1991 Kinigakis ..... B65D 77/225 220/359.3
5,229,180 A 7/1993 Littmann
5,423,449 A * 6/1995 Gordon ..... B65D 77/04 206/557
5,588,587 A * 12/1996 Stier ..... B65D 5/5455 206/557
5,667,827 A * 9/1997 Breen ..... B65B 25/067 426/108
5,686,126 A 11/1997 Noel et al.
5,779,050 A * 7/1998 Kocher ..... B32B 27/08 206/497
5,919,547 A 7/1999 Kocher et al.
5,958,484 A 9/1999 Gics
6,092,664 A * 7/2000 Bartosek ..... B65D 1/36 206/784
6,308,833 B1 * 10/2001 Oravez ..... B65D 77/0486 206/541
6,630,237 B2 10/2003 Rivett et al.
7,344,744 B2 * 3/2008 Sierra-Gomez .... B65D 75/5838 206/459.1
7,476,830 B2 1/2009 Middleton et al.
7,541,562 B2 6/2009 Cole et al.
7,608,317 B2 * 10/2009 Keckeisen ..... B32B 27/08 156/250
8,057,832 B2 * 11/2011 Forneck ..... A21D 2/183 426/106
8,087,827 B2 * 1/2012 Mir ..... B65D 33/01 383/102
8,302,528 B2 11/2012 Pawlick et al.
8,354,131 B2 * 1/2013 Gan ..... A21D 2/183 426/106
9,676,539 B2 * 6/2017 Sloat ..... B65D 81/3453
9,776,782 B2 * 10/2017 Klipstine ..... B65D 75/5833
9,790,014 B2 10/2017 Pilzecker
9,809,332 B2 * 11/2017 Valencia ..... B65D 77/2024
2002/0020151 A1 2/2002 DelDuca et al.
2003/0031763 A1 2/2003 Inagaki et al.
2003/0071036 A1 4/2003 Savage et al.
2008/0063759 A1 * 3/2008 Raymond ..... B65B 29/08 426/127
2008/0063760 A1 * 3/2008 Raymond ..... B65D 77/046 426/127
2009/0242550 A1 * 10/2009 Schneider ..... B65D 51/1633 219/730
2010/0151090 A1 * 6/2010 Arthur ..... A21D 15/02 426/113
2010/0323069 A1 * 12/2010 Rubinstein ..... B32B 25/08 426/113
2013/0078338 A1 * 3/2013 Thomas ..... B65D 77/02 426/89
2013/0114918 A1 * 5/2013 Lyzenga ..... B65B 9/067 383/203

FOREIGN PATENT DOCUMENTS

WO 9935039 7/1999
WO 2005077783 A1 8/2005
WO 2011146627 A1 11/2011
WO 2012166381 A1 12/2012

* cited by examiner

EASY-OPEN SELF-VENTING MICROWAVABLE TRAY AND OVERWRAP

BACKGROUND OF THE INVENTION

The present invention relates to self-venting packages including a tray surrounded by a single thermoplastic overwrap and particularly to self-venting ovenable packages having a single peelable thermoplastic overwrap heat sealed to the tray that includes a manual tear opening feature.

Various concerns arise in connection with the manufacture and use of food non-food packages. One area of concern is with respect to the cost of packaging components and the efficiency that they are assembled with the food items. For example, current packaging containers for microwavable meals include a tray on which a food item is supported and a separate plastic lidding film which is heat sealed to the rim of the tray to seal the food item within the package. The lidding film is normally sealed to the container in order to prevent leakage of fluids from within the container and also prevent ingress and egress of gases into and out of the container. Lidding films also help retain the moisture content, nutritional value, flavor, texture and appearance of the food. Often, a separate paperboard sleeve-type overwrap or paperboard carton is required which surrounds the sealed tray and provides a surface for product information and/or cooking instructions. It would be highly desirable minimize the cost of the packaging components by eliminating the paperboard sleeve-type overwrap or paperboard carton.

Another area of concern is with respect to ease of use during cooking of the food items and subsequent dispensing of the food items once cooked. When an air-tight unvented microwave package is heated in a microwave oven, pressure builds up in the sealed package holding the product. After a critical internal pressure is reached, the package can explode, spattering its contents over the oven interior. Before cooking the food item, the consumer is required to puncture the lidding film or remove a portion of the lidding film in order to reduce the internal pressure within the package and prevent explosion of the package during heating. Packaging which self-vents and have easy access to its contents is also highly desirable.

There is a need in the art for improved packages that address at least some of the above concerns, and which are simple in construction, can be made easily and inexpensively manufactured.

BRIEF SUMMARY OF THE INVENTION

The present invention is concerned with improved manually openable self-venting ovenable packages which include a rigid or semi-rigid tray having a base and at least one sidewall extending from the base thereby forming a recessed cavity; wherein the at least one sidewall comprises a peripheral flange extending generally perpendicularly from the at least one sidewall and which circumscribes the recessed cavity. The inventive packages also include a single thermoplastic overwrap comprising a polymeric laminate surrounding the tray and having a front panel and an opposing back panel having a longitudinal seal disposed underneath the base of the tray, a first leading end seal positioned substantially transverse to the longitudinal seal, and an opposing second trailing end seal positioned substantially transverse to the longitudinal seal. The overwrap further includes a first side edge and an opposing second side edge, where the side edges are positioned between the first leading end seal and the opposing second trailing end seal. The packages also include a peelable seal continuously circumscribing the recessed cavity which comprises an inner perimeter defined by a heat seal formed by heat sealing a portion of the front panel to the peripheral flange. Advantageously, the inventive packages of the present invention are self-venting whereby a venting region comprising a release coating applied between the inner surface of the front panel and the inner surface of the back panel permits the overwrap to rupture and release steam in response to heat and/or overpressure generated during heating of a food item in a microwave oven. The inventive packages also includes a manual tear opening feature provided by at least one line of weakness in the front panel positioned between the peelable seal and the first side edge of the front panel. The tear opening feature is configured to permit partial or complete removal of the overwrap from the tray.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
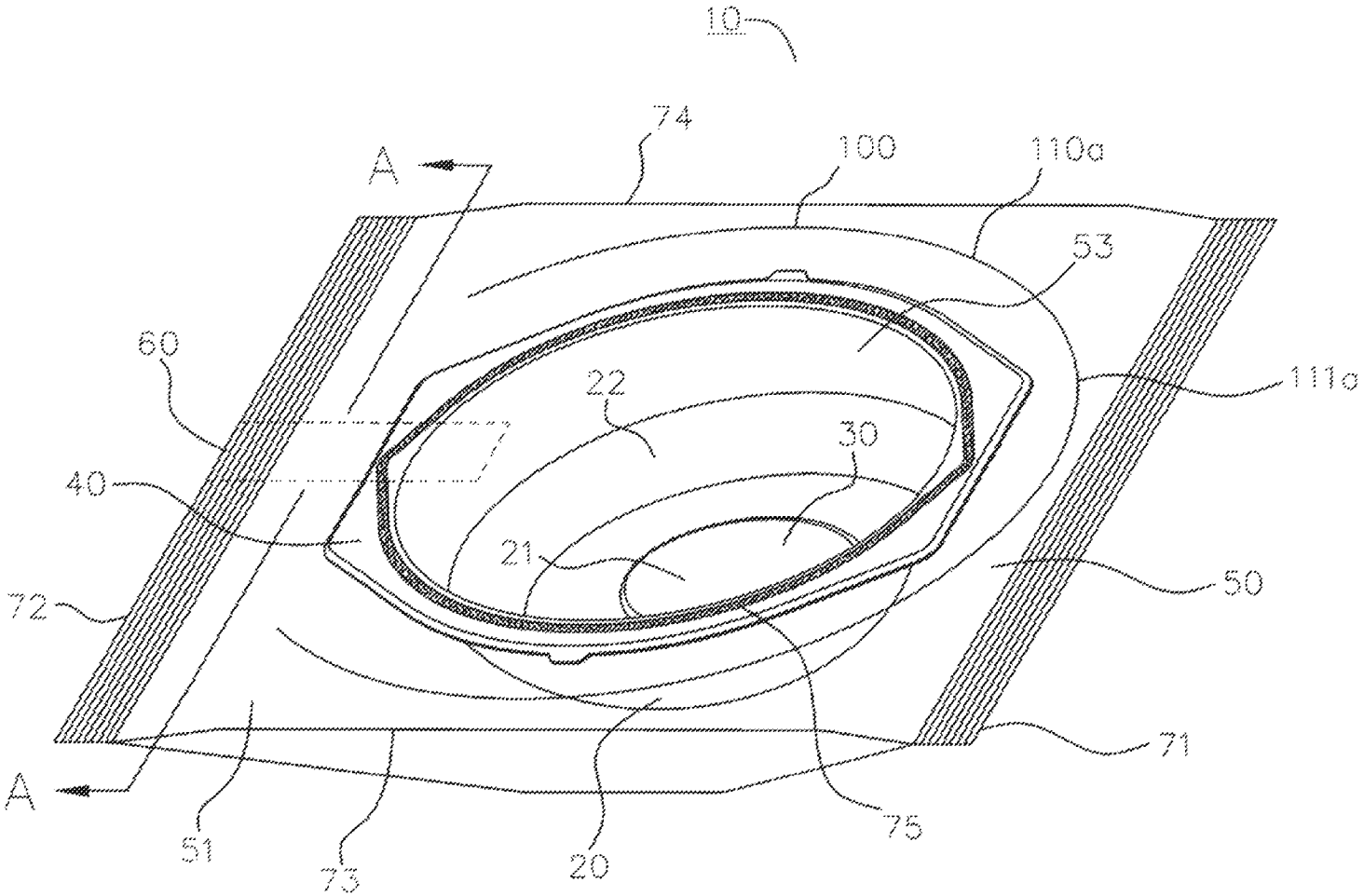
FIG. 1 depicts an isometric top perspective view of one embodiment of the present invention.
Figure 2:
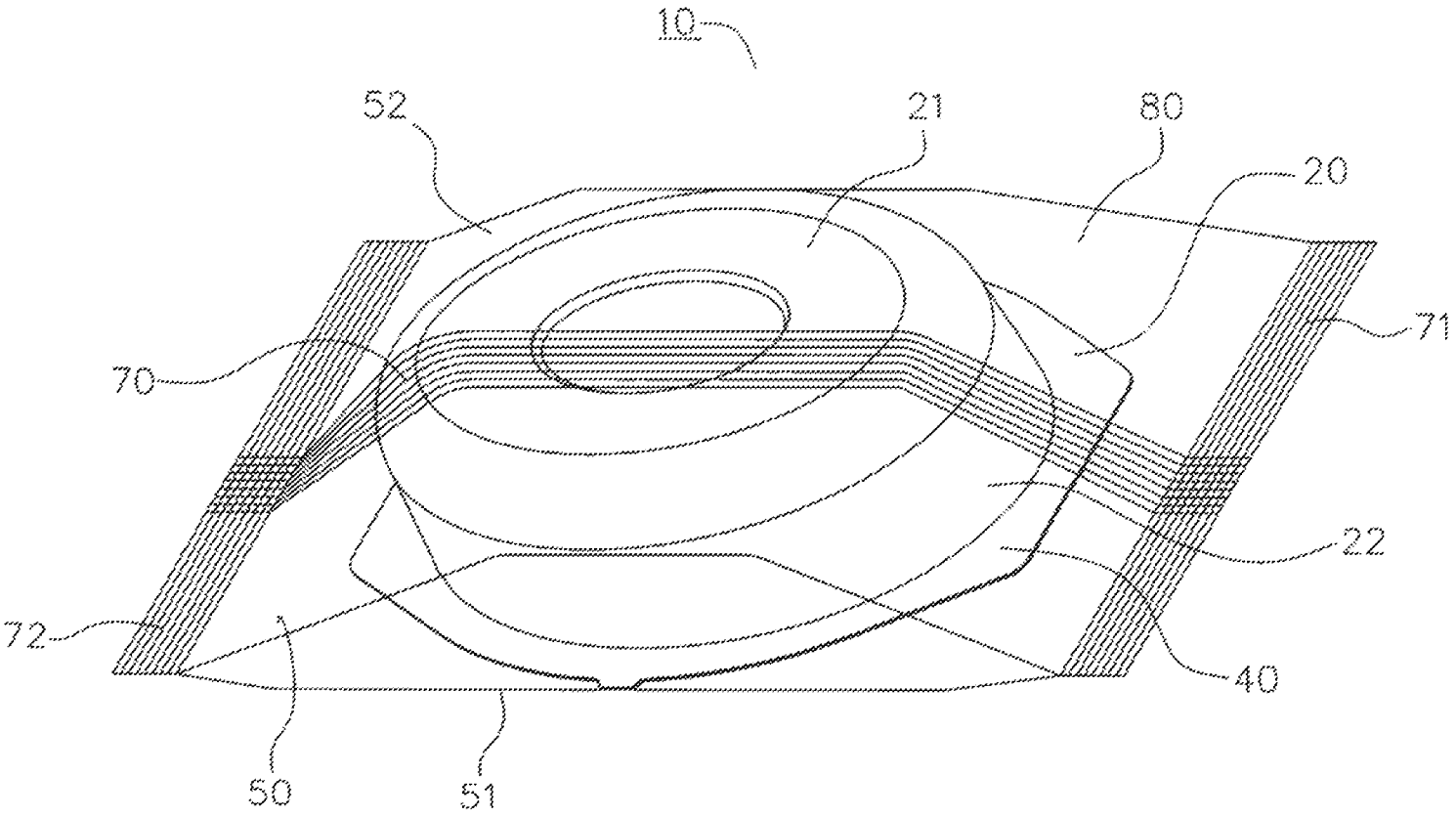
FIG. 2 depicts an isometric bottom perspective view of the present invention depicted in FIG. 1.
Figure 3:
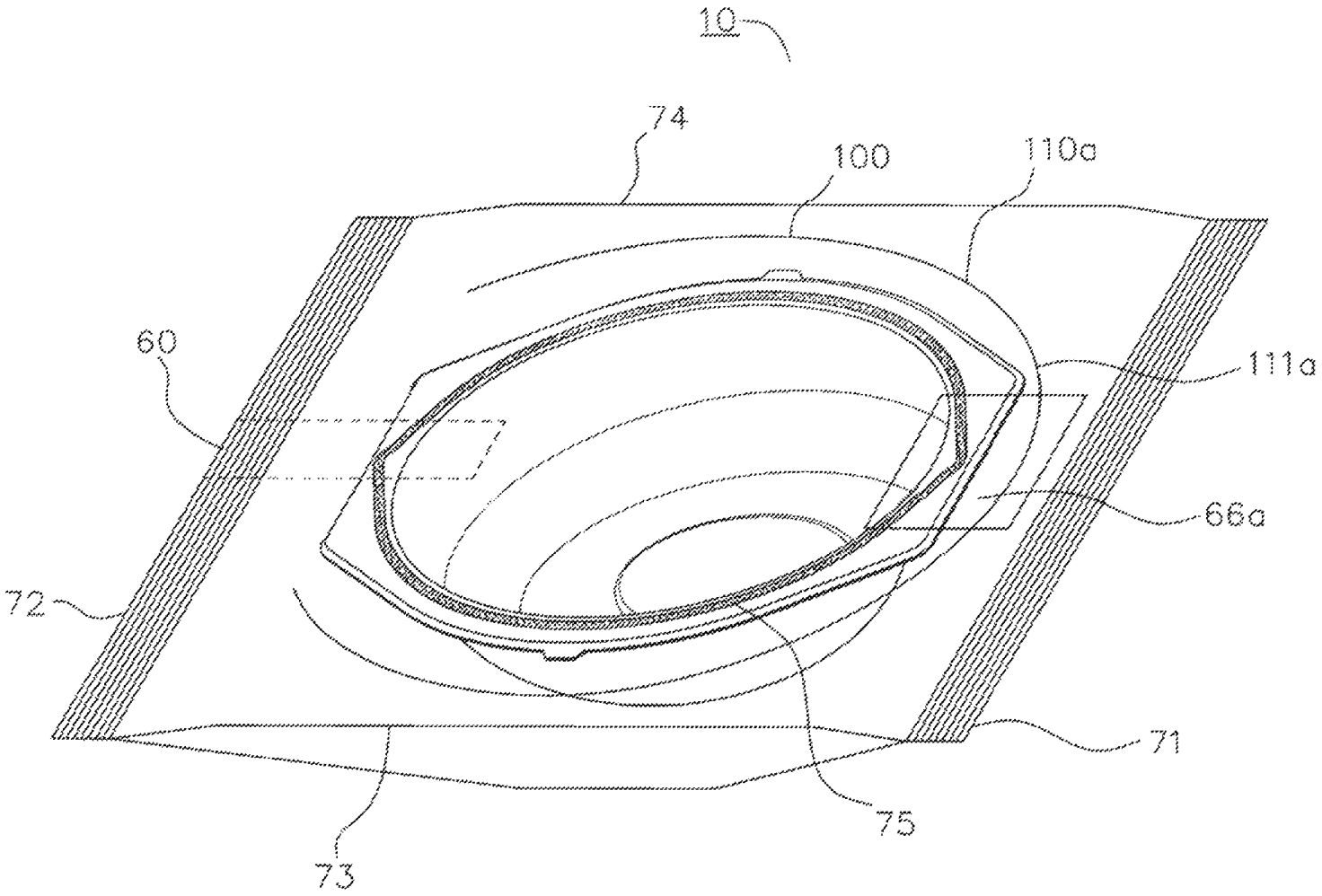
FIG. 3 depicts an isometric top perspective view of the present invention depicted in FIG. 1 having a pull-tab feature.

Referring now more particularly to FIGS. 1-3 of the drawings, a preferred embodiment of package 10 embodying the present invention is shown. The package 10 comprises a rigid or semi-rigid tray 20 having a recessed cavity 30 and a peripheral flange 40 circumscribing recessed cavity 30. The tray 20 can be made of any suitable material, however, it is preferred that the tray 20 be made of a plastic that can withstand exposure to the heating and/or cooking environment of a microwave oven. Most preferably, the plastic is polypropylene or crystallized polyethylene terephthalate ("CPET") although other plastics, such as, amorphous polyethylene terephthalate ("APET") or polystyrene may be used.

The tray 20 has a base 21 and a sidewall 22 extending from the base 21 which forms recessed cavity 30. The sidewall 22 of tray 20 terminates at peripheral flange 40 which circumscribes recessed cavity 30. It will be appreciated that tray 20 may be of the shape as shown in FIGS. 1-9 or any other shape, such as, for example, rectangular, square, circular or polygon depending on both functional and aesthetic requirements. It will be also appreciated that tray 20 may have any depth as desired depending upon type and amount of food product container therein. It will be further appreciated that tray 20 may be configured to include two or more recessed cavities depending again on both functional and aesthetic requirements.

As depicted, a single thermoplastic overwrap 50 comprises a polymeric laminate 80 (shown in FIGS. 8 and 9) and encloses tray 20 and includes a front panel 51 and an opposing back panel 52 (shown in FIG. 2). Front panel 51 includes an inner surface 51*a* and an outer surface 51*b* (shown in FIG. 9). Back panel 52 includes an inner surface 52*a* and an outer surface 52*b* (shown in FIG. 9). Back panel 52 is disposed underneath the base 21 of tray 20 and includes a longitudinal seal 70 (shown in FIG. 2). Preferably, longitudinal seal 70 is a heat seal or cold seal, and more preferably, a heat seal. Longitudinal seal 70 may be configured as either a fin seal or lap seal, and preferably as a fin seal. As used herein, the term "heat seal" refers to welding or melting of two polymeric surfaces together by the application of heat and pressure. It will be appreciated by those skilled in the art that heat seals can be hermetic seals meaning that they prevent the ingress of air and/or moisture through the seal. As used herein, the term "cold seal" refers to joining of two surfaces by the application of glue or other adhesive. Cold seal adhesives are well-known in the art. Thermoplastic overwrap 50 further comprises a first leading end seal 71 positioned substantially transverse to the longitudinal heat seal 70, an opposing second trailing end seal 72 positioned substantially transverse to the longitudinal seal 70, a first side edge 73, and an opposing second side edge 74. As depicted, first side edge 73 and an opposing second side edge 74 are each positioned between first leading end seal 71 and opposing second trailing end seal 72. Preferably, first leading end seal 71 and opposing second trailing end seal 72 are each a heat seal or cold seal, and more preferably, a heat seal. Preferably, first leading end seal 71 and opposing second trailing end seal 72 are each configured as a fin seal.

Front panel 51 includes a continuous peelable seal 75 which continuously circumscribes the recessed cavity 30 and comprises a perimeter defined by heat seal 76 formed by heat sealing a portion 53 of front panel 51 to the peripheral flange 40. It will be appreciated that this portion of front panel 51 covers recessed cavity 30 which then seals any food item within container 10. This reduces the cost of packaging by eliminating the need for a separate lidding film. Portion 53 also provides a relatively smooth surface for printing of indicia. Printing onto portion 53 may include graphics or colors to make package 10 more attractive to a potential consumer. Alternatively, portion 53 may be transparent and used for viewing of the food item contained within package 10 by a consumer. In addition, back panel 52 may be used to place other indicia, such as mandated by local food labeling laws, as well as, cooking instructions which may be desired to be placed on the package 10. In this way, the extra cost of a separate printed paperboard overwrap sleeve or a separate paperboard carton can now be eliminated by printing directly onto to front panel 51 and/or back panel 52 of package 10.

In accordance with an important aspect of the present invention, package 10 further includes a venting region 60 comprising a release coating 61 (shown in FIG. 9) interposed between the inner surface of the front panel and the inner surface of the back panel which permits the overwrap to rupture and release steam in response to heat and overpressure. Preferably, release coating 61 is a heat-sealable release coating, and more preferably, a solvent-based printable heat-sealable release coating. An example of a commercially available solvent-based printable heat-sealable release coating is PROXSEAL J9660MN supplied by Henkel Corporation (Cary, N.C.). Venting region 60 may be formed by gravure printing of a release coating 61 to the inner surface 51*a* of front panel 51 such that venting region is interposed between inner surface 51*a* of front panel 51 and inner surface 52*a* of back panel 52 (see FIG. 9). Venting region 60 should encompass an area which includes a portion of continuous peelable seal 75 and a portion of either first leading end seal 71 or opposing second trailing end seal 72 to establish fluid communication between recessed cavity 30 and the outside environment of the package during heating of a food product in a microwave oven in order to release pressured air and/or steam.

In accordance with another important aspect of the present invention, package 10 further includes a manual tear opening feature 100 comprising at least one line of weakness 110*a* in front panel 51 which is positioned between continuous peelable seal 75 and first side edge 73 of overwrap 50. Line of weakness 110*a* may have any shape, width or length provided that at least a portion or segment of the line of weakness is on front panel 51, and is positioned at a location outside the periphery of recessed cavity 30. Line of weakness 110*a* may be formed as continuous, intermittent or a combination of continuous and intermittent segments of scoring, cutting or perforations. Line of weakness 110*a* may be formed by any scoring, cutting or perforating methods known in the art. One example of a scoring technique which may be used to assist in the formation of manual tear opening feature 100 is optical ablation using a laser source. Laser scoring is well-known in the art. In a preferred embodiment, manual tear opening feature 100 is a line of weakness 110*a* formed having one or more scored segments. These scored segments may extend from the outer surface 51*b* of front panel 51 to a depth less than the total thickness of laminate 80 or completely through the total thickness of laminate 80. In one embodiment, one or more scored segments are intermittent perforations extending through the total thickness of laminate 80. In another embodiment, at least a first scored segment includes intermittent perforations extending through the total thickness of laminate 80 and at least a second scored segment includes continuous perforations which extend from the outer surface 51*b* of front panel 51 to a depth less than the total thickness of laminate 80.

In a preferred embodiment, line of weakness 110*a* in front panel 51 has a shape which substantially replicates the shape of at least a portion of recessed cavity 30 as depicted in FIGS. 1-3. In a preferred embodiment, line of weakness 110*a* comprises a nonlinear scored segment 111*a* which at least partially or completely circumscribes the perimeter of continuous peelable seal 75. As used herein, the term "nonlinear" refers to a curved line section. In contrast, the term "linear" as used herein refers to a straight line section. It is also contemplated that package 10 may further include a pull-tab 66*a* which further facilitates opening of the package as illustrated in FIG. 3. Pull-tab 66*a* may be provided as a separate adhesive label being placed at any position on line of weakness 110*a*. In one preferred embodiment, pull-tab 66*a* includes a first edge permanently affixed to front panel 51 on line of weakness 110*a* and an opposing second edge which is not affixed to front panel 51. The most preferable location for the separate adhesive label-type pull-tab is approximately at the midpoint of the line of weakness 110*a* and opposite to venting region 60.

Figure 4:
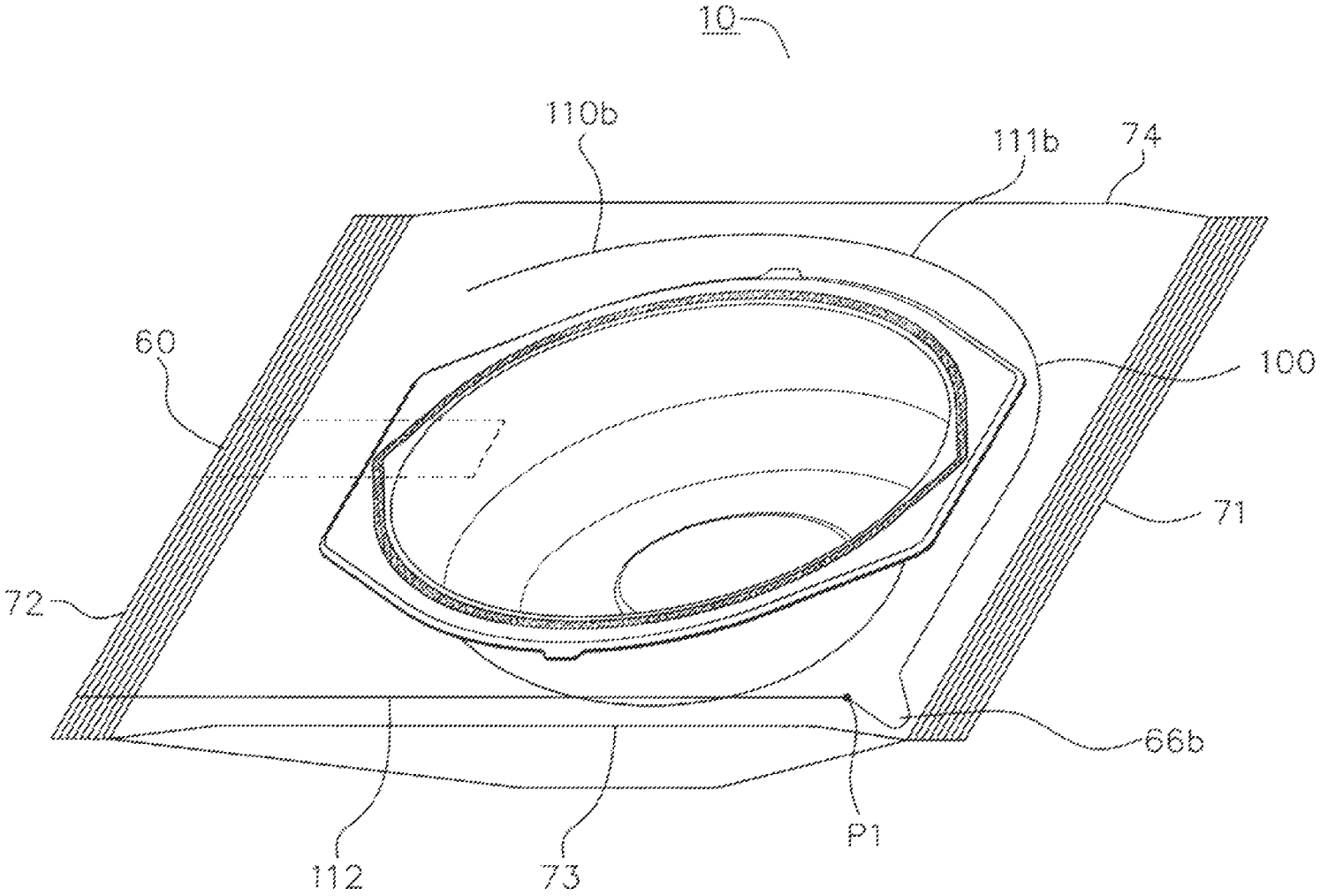
FIG. 4 depicts an isometric top perspective view of another embodiment of the present invention.

In an alternative embodiment, manual tear opening feature 100 includes a line of weakness 110*b* in front panel 51 formed from two scored segments. As illustrated in FIG. 4, line of weakness 110*b* may comprise a first linear scored segment 112 positioned adjacent to first edge 73 of overwrap 50 and between first edge 73 of overwrap 50 and continuous peelable seal 75, and a second nonlinear scored segment 111*b* which circumscribes a portion of the perimeter of continuous peelable seal 75 and is positioned between continuous peelable seal 75 and second side edge 74 of overwrap 50. In a preferred embodiment, first linear scored segment 112 intersects with second nonlinear scored segment 111*b*. This intersection of scored segments may occur at point, $P_1$ as illustrated in FIG. 4. It is also contemplated that package 10 may include an integrally formed pull-tab 66*b* which consists essentially of overwrap 50 and defined by a protruding partial circular or elliptical area of second nonlinear scored segment 111*b* as shown in FIG. 4.

Figure 5:
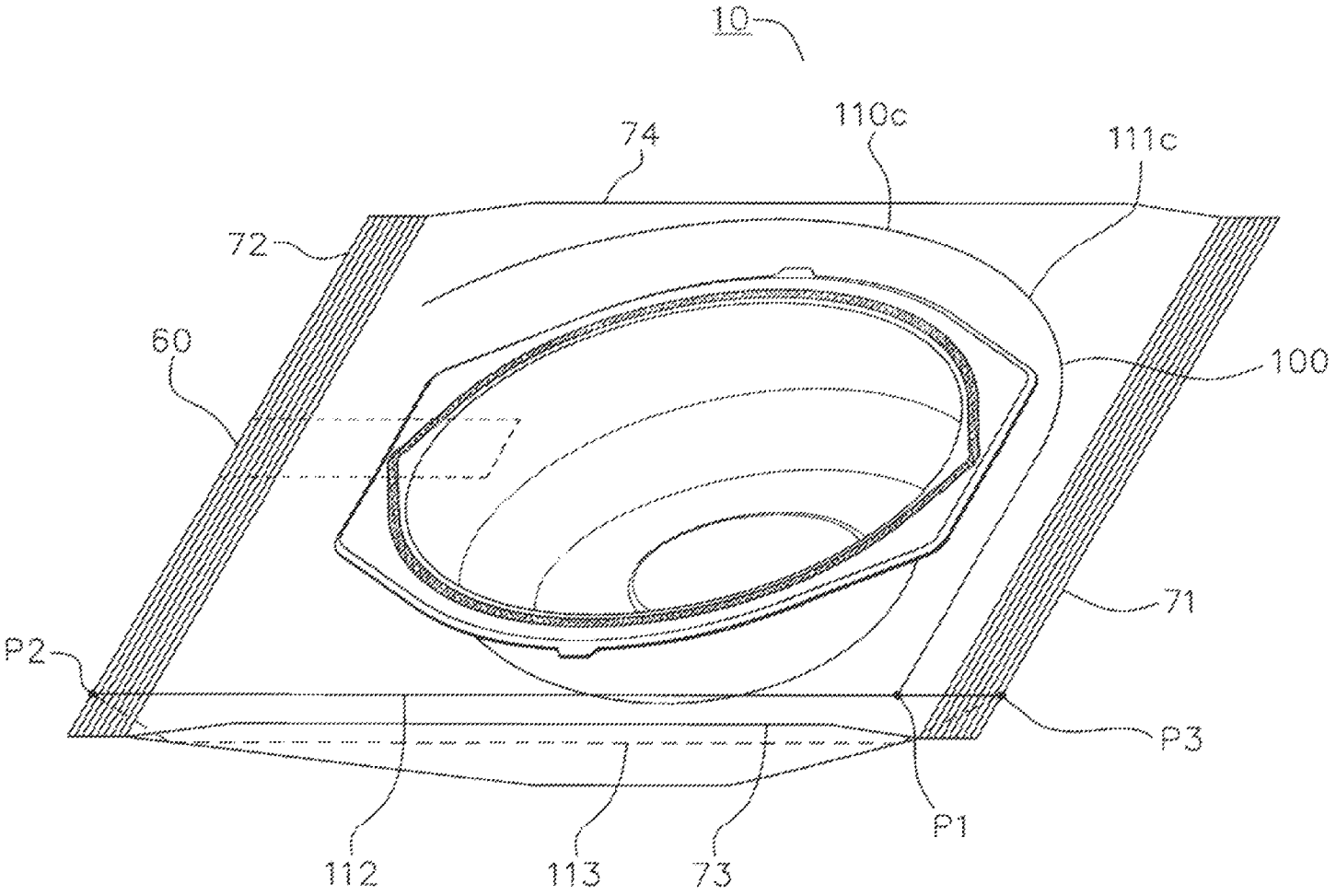
FIG. 5 depicts an isometric top perspective view of another embodiment of the present invention.

In still another preferred embodiment, manual tear opening feature 100 may comprise a line of weakness 110*c* in front panel 51 having two scored segments and at least one line of weakness 113 in back panel 52. FIG. 5 illustrates one embodiment having a first linear scored segment 112 positioned adjacent to first edge 73 of overwrap 50 and between first edge 73 of overwrap 50 and continuous peelable seal 75, and a second nonlinear scored segment 111*c* which circumscribes a portion of the perimeter of continuous peelable seal 75 and is positioned between continuous peelable seal 75 and second side edge 74 of overwrap 50. As depicted, line of weakness 113 in back panel 52 is shown as a linear scored segment adjacent to first side edge 73 of overwrap 50. In a preferred embodiment, first linear scored segment 112 and line of weakness 113 in back panel 52 each have a length extending from first leading end seal 71 to opposing trailing end seal 72. In a preferred embodiment, first linear scored segment 112 intersects second nonlinear scored segment 111*c* at point $P_1$, and intersects line of weakness 113 in back panel 52 at points $P_2$ and $P_3$. It will be appreciated that the point of intersection $P_1$ may vary depending upon the relative distance first linear scored segment 112 is positioned away from first edge 73 of front panel 51.

Figure 6:
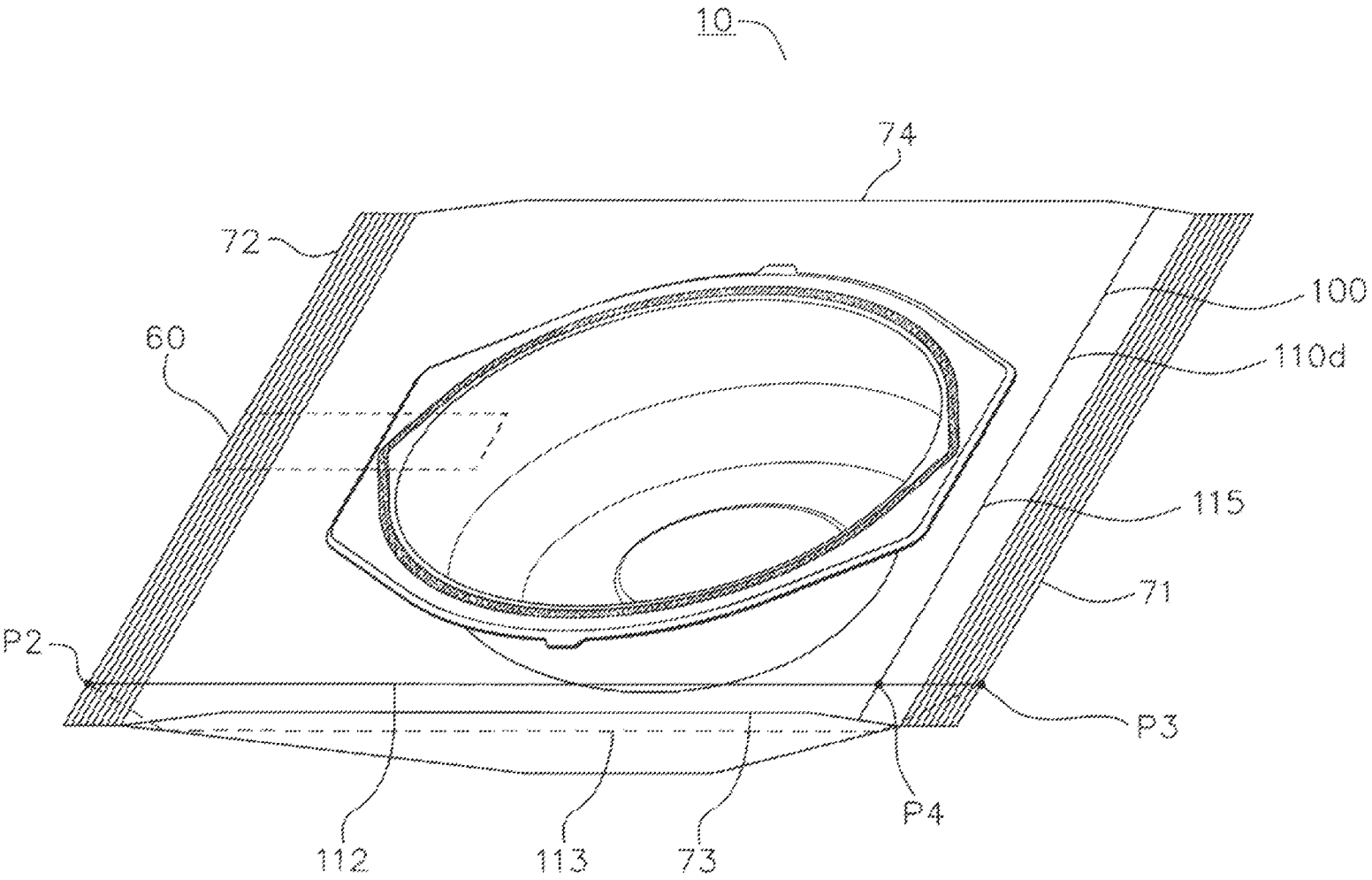
FIG. 6 depicts an isometric top perspective view of another embodiment of the present invention.
Figure 7:
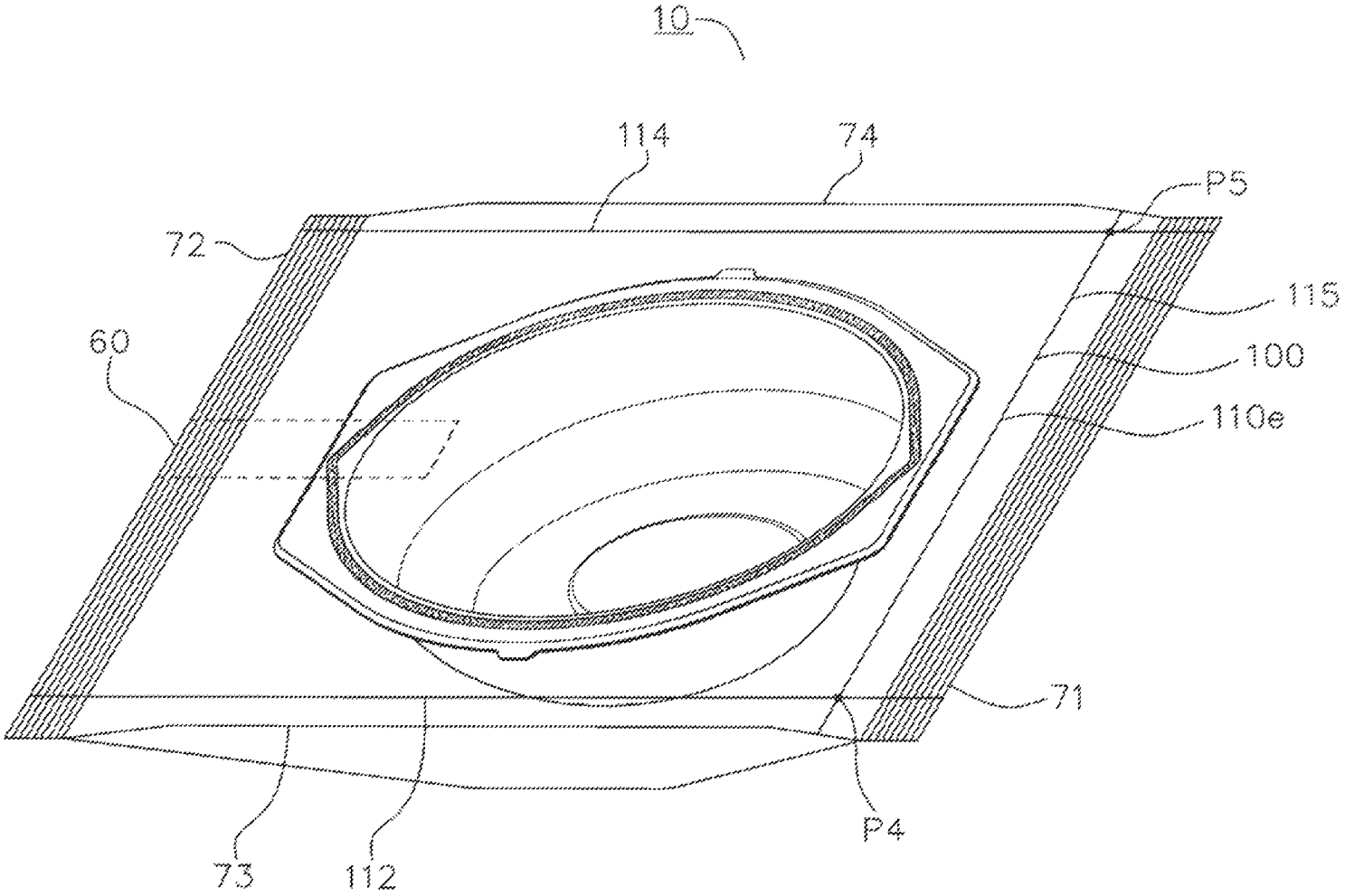
FIG. 7 depicts an isometric top perspective view of another embodiment of the present invention.

In still other alternative embodiments, FIGS. 6 and 7 depict manual tear opening feature 100 comprising a line of weakness 110*d* in front panel 51 having a first linear scored segment 112 positioned adjacent to first edge 73 of overwrap 50 and between first edge 73 of overwrap 50 and continuous peelable seal 75, and a second linear scored segment 115 in front panel 51 positioned perpendicular to the first linear scored segment 112 and located adjacent to first leading end seal 71. Preferably, first linear scored segment 112 has a length extending from first leading end seal 71 to opposing trailing end seal 72, and second linear scored segment 115 has a length extending from first side edge 73 of overwrap 50 to second side edge 74 of overwrap 50. In a preferred embodiment, first linear scored segment 112 intersects second linear scored segment 115 in front panel 51 at point $P_4$. It will also be appreciated that point of intersection $P_4$ may vary depending upon the relative distance first linear scored segment 112 is positioned away from first edge 73 of overwrap 50 or the relative distance second linear scored segment 115 is positioned away from first leading end seal 71.

As shown in FIG. 6, in addition to first linear scored segment 112 and second linear scored segment 115 in front panel 51 positioned perpendicular to the first linear scored segment 112, manual tear opening feature 100 may further include a least one line of weakness 113 in back panel 52 which is a linear scored segment positioned adjacent to first side edge 73 of overwrap 50. In a preferred embodiment, first linear scored segment 112 intersects line of weakness 113 in back panel 52 at points $P_2$ and $P_3$.

In FIG. 7, an alternative embodiment is shown where in addition to first linear scored segment 112 and second linear scored segment 115 in front panel 51 positioned perpendicular to the first linear scored segment 112, manual tear opening feature 100 further includes a third line of weakness 114 in front panel 51. Third line of weakness 114 is a linear scored segment positioned adjacent to second side edge 74 of overwrap 50 and between second side edge 74 of overwrap 50 and continuous peelable seal 75. In a preferred embodiment, third line of weakness 114 of front panel 51 intersects first linear scored segment 112 and second linear scored segment 115 in front panel 51 at points $P_4$ and $P_5$. It should be appreciated points of intersection $P_4$ and $P_5$ may vary depending upon the relative distance third line of weakness 114 is positioned away from second side edge 74 of overwrap 50, the relative distance first linear scored segment 112 is positioned away from first edge 73 of overwrap 50, or the relative distance second linear scored segment 115 in front panel 51 is positioned away from first leading end seal 71.

Preferably, thermoplastic overwrap 50 comprises a material which will not melt or otherwise deteriorate during heating of the food items in a microwave oven. Preferably, thermoplastic overwrap 50 is constructed from a material that will sufficiently not retain heat to prevent discomfort or burning to the consumer upon handling following microwave cooking. It will be appreciated that the choice of materials used to form overwrap 50 may be determined by the nature of the food items to be packaged in the package 10. For example, packaging of refrigerated foods, overwrap 50 must by substantially impermeable to gases and/or water vapor. Packaging for refrigerated foods will often include oxygen barrier materials such as one or more layers of polyamide and ethylene vinyl alcohol copolymer. The constructions of the overwrap of the invention will be discussed in greater detail below.

Figure 8:
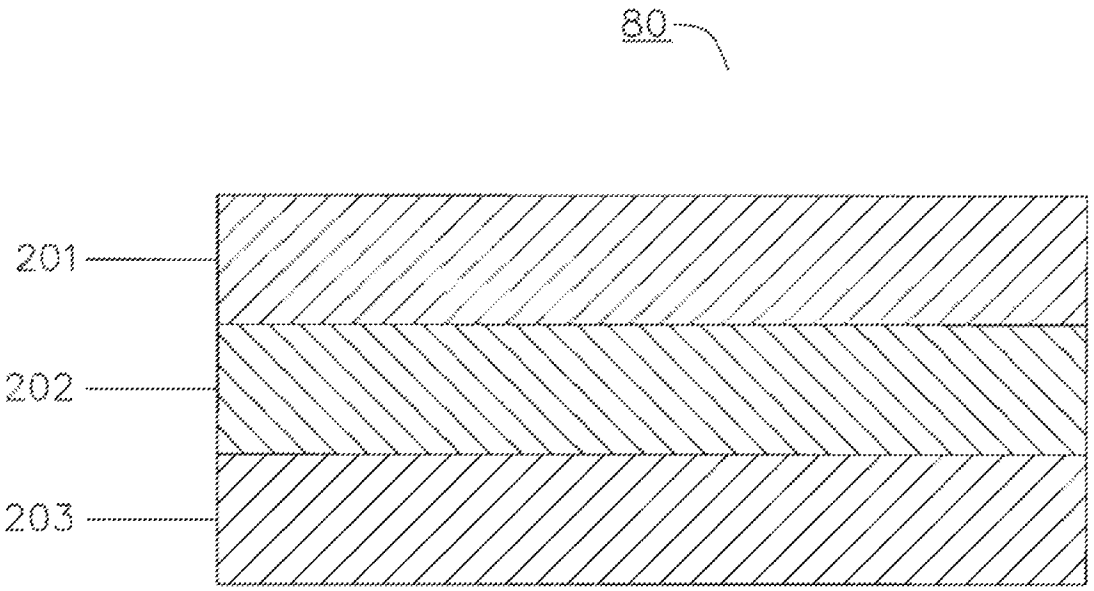
FIG. 8 depicts a cross-sectional view of a general embodiment of a polymeric film structure suitable for use as an overwrap with the present invention.

FIG. 8 is a cross-sectional view of an example of a preferred embodiment of a thermoplastic overwrap 50 comprising a polymeric laminate 80. As depicted, laminate 80 includes a multilayer structure formed by lamination of a first film 201 of polyethylene terephthalate to a second film 203 via an adhesive layer 202. In an alternative example, film 201 may include polyamide, polypropylene, polystyrene or polyethylene. Preferably, film 201 is oriented, more preferably, uniaxially oriented in either the machine direction or transverse direction and more preferably, biaxially oriented in both the machine direction and the transverse direction. Preferably, film 201 is a biaxially oriented polyethylene terephthalate film which is heat annealed to render the film substantially non-heat shrinkable, e.g., a film having a heat shrinkage of less than about 15%, more preferably, less than 10% and most preferably, less than 5% in either the machine and/or transverse direction. The total thickness of film 201 is generally from about 36 gauge to 142 gauge (or 9.14 microns to 36.10 microns), typically, from 42 gauge to about 92 gauge (or about 10.67 microns to about 23.37 microns).

In one embodiment, second film 203 is a monolayer as illustrated in FIG. 8. Second film 203 may comprise any polyolefin including, but not limited to, polyethylene, preferably, low density polyethylene, and more preferably, linear low density polyethylene, ethylene vinyl acetate copolymer, polypropylene or combinations thereof. In another alternative embodiment, second film 203 may have any number of layers depending on the functional properties desired. Second film 203 may be formed by coextrusion of one or more polymeric materials by cast coextrusion or blown coextrusion techniques. Preferably, second film 203 is formed by blown coextrusion methods. The total thickness of second film 203 is generally from about 12.7 μm (0.5 mil) to about 254 μm (10 mil), typically from about 50.8 μm (2 mil) to about 178 μm (7 mil), most typically from about 63.5 μm (2.5 mil) to about 127 μm (5 mil).

In accordance with the present invention, second film 203 may be a multilayered film which includes oxygen barrier materials that provides an oxygen transmission rate of less than about 1.0 $cm^3/100\ in^2/24$ h at 73° F., 0% RH and 1 atm (or about 15.5 $cm^3/m^2/24$ h at 23° C., 0% RH and 1 atm), preferably, less than about 0.5 $cm^3/100\ in^2/24$ h at 73° F., 0% RH and 1 atm (or about 7.75 $cm^3/m^2/24$ h at 23° C., 0% RH and 1 atm), and most preferably, about 0.2 $cm^3/100\ in^2/24$ h at 73° F., 0% RH and 1 atm (or about 3.1 $cm^3/m^2/24$ h at 23° C. 0% RH and 1 atm). In accordance with the present invention, second film 203 includes water barrier materials, such as a polyolefin, particularly, polyethylene which provides a water vapor transmission rate less than about 1.0 $g/100\ in^2/24$ h at 73° F., 90% RH and 1 atm (or about 15.5 $g/m^2/24$ h at 23° C., 90% RH and 1 atm) and preferably, about 0.2 $g/100\ in^2/24$ h at 73° F., 90% RH and 1 atm (or about 3.1 $g/m^2/24$ h at 23° C., 90% RH and 1 atm). Second film 203 may comprise both oxygen barrier materials and water barrier materials.

The following example illustrates a certain particular embodiment of a polymeric laminate suitable for use as an overwrap in the present invention and is not to be interpreted as limiting. In the following example, resin composition percentages are based on the total weight of each film layer. In the following example, first film 201 was purchased as free-standing film which was adhesively laminated via adhesive layer 202 to a free-standing second film 203.

Figure 9:
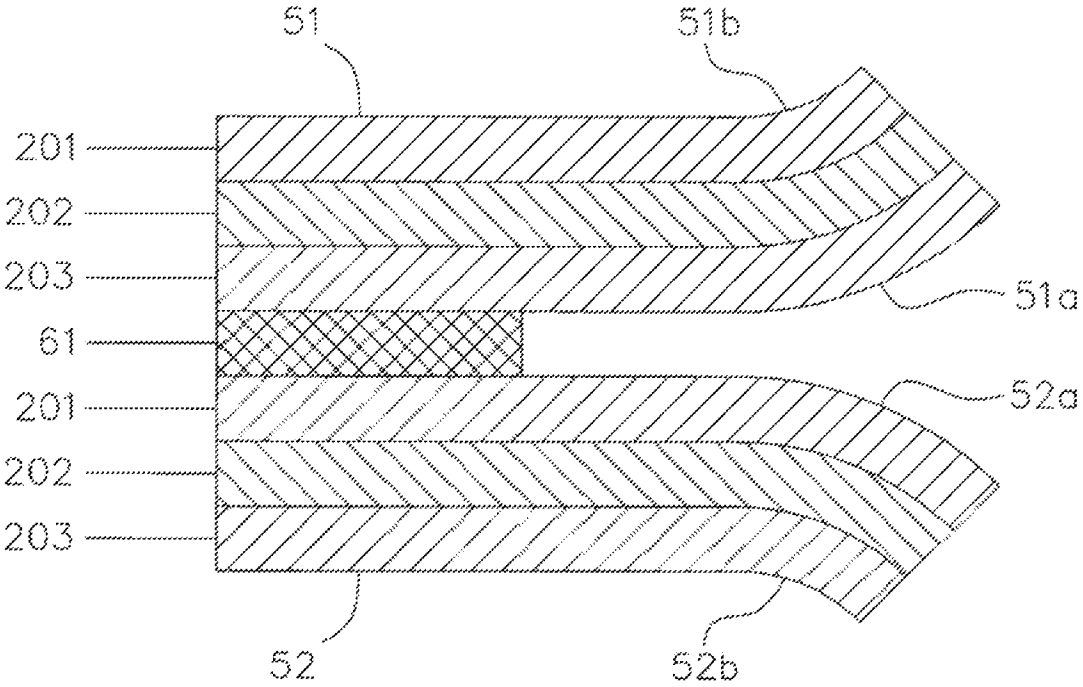
FIG. 9 depicts a cross-sectional view of a general embodiment of a polymeric film structure depicted in FIG. 8 taken through section A-A of FIG. 1.

Example 1 is one embodiment of a polymeric laminate suitable for use as a thermoplastic overwrap of the present invention having a general structure 80 as illustrated in FIGS. 8 and 9. A reverse printed mono-layer film 201 was bonded with a standard solventless laminating adhesive is a solvent-based adhesive 202 to a 2.0 mil thick coextruded multilayer film 203. The mono-layer film 201 was a 92-gauge biaxially oriented polyethylene terephthalate (OPET) free-standing substrate (SKYROL® SP65 supplied by SKC, Inc., Covington, Ga.). The solvent-based adhesive 202 was a solvent based polyurethane adhesive. An example of a suitable polyurethane adhesive includes AVADYNE® AV5210/CA500-83. The AVADYNE® AV521 0/CA500-83 system is identified as two-component ethanol-based adhesive having an amine-terminated polyurethane pre-polymer and an epoxy-terminated ether co-reactant, and may be purchased from Henkel KGaA, Dusseldorf, Germany. Coextruded multilayer film 203 was a 3-layer structure comprising a first layer bonded to adhesive 202 which comprised a blend of 60% ultra-low density polyethylene (ATTANE® 4701 copolymer supplied by Dow Chemical Company, Midland, Mich.), 35% linear low density polyethylene (ExxonMobil™ LLDPELL 1001.32 supplied by ExxonMobil Chemical Company, Houston, Tex.), and 5% processing additives, a second layer of a blend of 83% polyethylene/ethylene vinyl acetate copolymer having 5% vinyl acetate content (PETROTHENE® NA442 supplied by Lyondell Chemical Company, Houston, Tex.) and 17% polybutene copolymer (Polybutene-1 PB 8640M supplied by Basell Service Company B.V., Rotterdam, Netherlands), and a third heat-sealable layer of polyethylene/ethylene vinyl acetate copolymer having 5% vinyl acetate content (PETROTHENE® NA442 supplied by Lyondell Chemical Company, Houston, Tex.). It is to be appreciated that other layers or films could be positioned between film 201 and adhesive 202 or between adhesive 202 and film 203 depending on the desired properties of the resulting laminate.

The packages of the present invention may be formed and assembled in a variety of manners. One exemplary process for producing the packages includes providing a first film and reverse printing onto this film followed by adhesively laminating a second film to the first film to form the overwrap laminate. Adhesive lamination techniques or other well-known lamination methods may be used for securing the first film to the second film. Once the overwrap laminate is formed, a release coating is applied in-register to the inner surface of the laminate which corresponds to the inner surface of the front panel of the overwrap. The inner surface of the laminate will most often be the heat-sealable layer of a film used to form the overwrap laminate. If the release coating is a solvent-borne material, it is then dried through a drying oven. Following the application of the release coating, the inner and/or outer surface of the overwrap is then scored, cut and/or perforated to provide the manual tear opening feature. As mentioned previously, the manual tear opening feature comprises at least one line of weakness in the overwrap laminate and may encompass various linear and/or nonlinear scored segments. It will be appreciated that if the laminate includes a barrier film, e.g., one or more layers of barrier material, the scoring, cutting and/or perforating is performed in such a manner as to not affect the barrier properties of the laminate. The linear and nonlinear scored segments may be produced by mechanical means such as, for example, cutting blade or roller or by optical ablation. Preferably, the linear and nonlinear scored segments are produced by optical ablation using a laser beam which affords more control over the shape, size and depth of penetration of the scoring. It will be appreciated that the step of providing the manual tear opening feature may occur before or after the step of applying the release coating to the overwrap.

After providing the manual tear opening feature, the tray may then be filled with a food product and the overwrap placed over the tray and sealed to the flange of the tray. Preferably, overwrap is sealed to the tray such that a continuously seal is formed circumscribing the perimeter of the recessed cavity. Preferably, the overwrap is sealed as a heat seal. Heat sealing can be achieved by bringing the surface of the overwrap into contact the surface of the flange and then applying sufficient heat and pressure to a predetermined area of the two surfaces to cause the contacting surfaces to become molten and intermix with one another, thereby forming as essentially inseparable fusion bond between the two surfaces in the predetermined area when the heat and pressure are removed therefrom and the area is allowed to cool. In one embodiment, the heat seal of the overwrap to the flange of the tray is a non-hermetic heat seal. In another embodiment, the heat seal of the overwrap to the flange of the tray is a hermetic heat seal. Once the overwrap is sealed to the flange of the tray, the overwrap is folded around the tray and a longitudinal seal is formed underneath the base of the tray. Preferably, the longitudinal seal is configured as a fin seal. Alternatively, the longitudinal seal can be configured as a lap seal. Sealing the overwrap underneath the base of the tray forms the front panel and the opposing back panel of the package. It is preferred to form the longitudinal seal as a heat seal.

After forming the longitudinal seal, a first leading end seal positioned substantially transverse to the longitudinal seal and an opposing second trailing end seal positioned substantially transverse to the longitudinal seal are then formed. Preferably, each of the end seals are formed as fin seals by heat sealing the inner surfaces of the front and back panels together which extend beyond the perimeter of the tray. After the end seals are formed, the leading end and trailing end of the overwrap are cut to individualize each package.

In an alternative method, the overwrap is first folded around the tray and a longitudinal seal is formed underneath the base of the tray. After forming the longitudinal seal, a first leading end seal positioned substantially transverse to the longitudinal seal and an opposing second trailing end seal positioned substantially transverse to the longitudinal seal are then formed. Following formation of the ends seal, the overwrap is then heat sealed to the flange of the tray. The heat sealing of the overwrap to the tray flange may be accomplished such a manner known to those skilled in the art so that either a hermetic or non-hermetic heat seal is formed.

Once package has been individualized, a separate label-type pull-tab may then be adhesively applied to the removable portion of the package at a location near or on a line of weakness. Preferably, the pull-tab is placed at a location which generally corresponds to the mid-point on the line of weakness. The pull-tab may have at least a first edge which is permanently affixed to the removable portion of the front panel. The pull-tab may further have an opposing second edge which is peelably affixed to the front panel of the package.

The invention claimed is:

1. An easy-open self-venting ovenable package comprising:

a rigid or semi-rigid tray having a base and at least one sidewall extending from said base thereby forming a recessed cavity; wherein said at least one sidewall comprises a peripheral flange extending generally perpendicularly from said at least one sidewall and circumscribing said recessed cavity:

a single thermoplastic overwrap surrounding said tray and comprising polymeric laminate; wherein said single thermoplastic overwrap comprises a first side edge, an opposing second side edge, a front panel and an opposing back panel comprising a longitudinal seal, a first leading end seal positioned substantially transverse to said longitudinal seal, an opposing second trailing end seal positioned substantially transverse to said longitudinal seal; wherein said front panel and said opposing back panel each have an inner surface and an outer surface;

a continuous peelable seal circumscribing said recessed cavity and comprising an inner perimeter defined by a heat seal formed by heat sealing a portion of said front panel to said peripheral flange;

a venting region comprising a release coating interposed between said inner surface of said front panel and said inner surface of said back panel;

and a manual tear opening feature comprising at least one line of weakness in said front panel positioned between said peelable seal and said first side edge of said front panel.

2. The package according to claim 1, wherein said at least one line of weakness comprises a nonlinear scored segment which partially circumscribes the perimeter of said peelable seal.

3. The package according to claim 2, wherein said nonlinear scored segment is continuous.

4. The package according to claim 2, wherein said nonlinear scored segment is intermittent.

5. The package according to claim 2, wherein said nonlinear scored segment extends from said outer surface of said front panel to a depth less than the total thickness of said polymeric laminate.

6. The package according to claim 2, wherein said nonlinear scored segment extends through the total thickness of said polymeric laminate.

7. The package according to claim 1, wherein said at least one line of weakness comprises a nonlinear scored segment which entirely circumscribes the perimeter of said peelable seal.

8. The package according to claim 7, wherein said nonlinear scored segment is intermittent and extends through the total thickness of said polymeric laminate.

9. The package according to claim 1, wherein said at least one line of weakness in said front panel comprises:

a first linear scored segment positioned adjacent to said first edge of said front panel and between said first side edge of said single thermoplastic overwrap and said peelable seal, and a second nonlinear scored segment circumscribing a portion of said perimeter of said peelable seal which is positioned between said peelable seal and said second side edge of said single thermoplastic overwrap; wherein said first linear scored segment intersects said second nonlinear scored segment.

10. The package according to claim 9, wherein said first linear scored segment and said second nonlinear scored segment are each continuous and extend from said outer surface of said front panel to a depth less than the total thickness of said polymeric laminate.

11. The package according to claim 9, wherein said first linear scored segment of said front panel is continuous and extends from said outer surface of said front panel to a depth less than the total thickness of said polymeric laminate, and said nonlinear scored segment of said front panel is intermittent and extends through the total thickness of said polymeric laminate.

12. The package according to claim 9, further comprising:

at least one line of weakness in said back panel: wherein said at least one line of weakness of said back panel is a linear scored segment adjacent to said first side edge of said single thermoplastic overwrap; wherein said at least one line of weakness of said back panel intersects said first linear scored segment of said front panel.

13. The package according to claim 12, wherein said first linear scored segment of said front panel is continuous and extends from said outer surface of said front panel to a depth less than the total thickness of said polymeric laminate, said at least one line of weakness of said back panel is continuous and extends from said outer surface of said back panel to a depth less than the total thickness of said polymeric laminate, and said second nonlinear scored segment of said front panel is continuous and extends from said outer surface of said front panel to a depth less than the total thickness of said polymeric laminate.

14. The package according to claim 12, wherein said first linear scored segment of said front panel is continuous and extends from said outer surface of said front panel to a depth less than the total thickness of said polymeric laminate, said at least one line of weakness of said back panel is continuous and extends from said outer surface of said back panel to a depth less than the total thickness of said polymeric laminate, and said second nonlinear scored segment of said front panel is intermittent and extends through the total thickness of said polymeric laminate.

15. The package according to claim 1, wherein said at least one line of weakness of said front panel is a first line of weakness of said front panel; wherein said first line of weakness of said front panel is a linear scored segment positioned adjacent to said first side edge of said single thermoplastic overwrap and between said first side edge of said overwrap and said peelable seal; wherein said package further comprising:

a second line of weakness in said front panel which is a linear scored segment positioned substantially perpendicular to said first line of weakness of said front panel and located adjacent to said first leading end seal; wherein said second line of weakness of said front panel intersects with said first line of weakness of said front panel; and either:

i) a first line of weakness in said back panel; wherein said first line of weakness of said back panel is a linear scored segment positioned adjacent to said first side edge of said single thermoplastic overwrap; wherein said first line of weakness of said back panel intersects with said first line of weakness of said front panel; or ii) a third line of weakness in said front panel; wherein said third line of weakness of said front panel is a linear scored segment positioned adjacent to said second side edge of said single thermoplastic overwrap and between said second side edge of said single thermoplastic overwrap and said peelable seal; wherein said third line of weakness of said front panel intersects with said second line of weakness of said front panel.

16. The package according to claim 15, wherein said first linear scored segment is continuous and extends from said outer surface of front panel to a depth less than the total thickness of polymeric laminate; said second linear scored segment of said front panel is continuous and extends from said outer surface of front panel to a depth less than the total thickness of polymeric laminate, and said at least one line of weakness in said back panel is continuous and extends from said outer surface of back panel to a depth less than the total thickness of polymeric laminate.

17. The package according to claim 15, wherein said first linear scored segment is continuous and extends from said outer surface of front panel to a depth less than the total thickness of polymeric laminate, said second linear scored segment of said front panel is intermittent and extends through the total thickness of said polymeric laminate, and said at least one line of weakness in said back panel is continuous and extends from said outer surface of back panel to a depth less than the total thickness of polymeric laminate.

18. The package according to claim 15, wherein said first linear scored segment is continuous and extends from said outer surface of front panel to a depth less than the total thickness of polymeric laminate, said second linear scored segment of said front panel is intermittent and extends through the total thickness of said polymeric laminate, and third line of weakness in said front panel is continuous and extends from said outer surface of back panel to a depth less than the total thickness of polymeric laminate.

19. The package according to claim 1, wherein said longitudinal seal is a heat seal.

20. The package according to claim 1, wherein said first leading end seal and said opposing second trailing end seal are each a heat seal.

21. The package according to claim 1, wherein said longitudinal heat-seal is a fin seal.

22. The package according to claim 1, wherein said longitudinal heat-seal is a lap seal.

23. The package according to claim 1, wherein said package is a microwavable package.

24. The package according to claim 1, wherein said release coating is a heat-sealable release coating.

25. The package according to claim 24, wherein said heat-sealable release coating is a solvent-based printable heat-sealable release coating.

26. The package according to claim 1, wherein said venting region comprises an area which includes a portion of either said first leading end seal or said opposing second trailing end seal, and a portion of said continuous peelable seal.

* * * * *